US008342827B2

(12) United States Patent
Cho et al.

(10) Patent No.: US 8,342,827 B2
(45) Date of Patent: Jan. 1, 2013

(54) HERMETIC COMPRESSOR AND REFRIGERATION CYCLE DEVICE HAVING THE SAME

(75) Inventors: Nam-Kyu Cho, Seoul (KR); Hyo-Keun Park, Seoul (KR); Byeong-Chul Lee, Seoul (KR); Se-Heon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 644 days.

(21) Appl. No.: 12/591,263

(22) Filed: Nov. 13, 2009

(65) Prior Publication Data

US 2010/0122550 A1 May 20, 2010

(30) Foreign Application Priority Data

Nov. 14, 2008 (KR) ..... 10-2008-0113671

(51) Int. Cl.
*F01C 1/02* (2006.01)

(52) U.S. Cl. ..... 418/55.6; 62/469; 417/390

(58) Field of Classification Search ..... 62/84, 138, 62/139, 149, 192–193, 324.1, 324.4, 324.6, 62/467–473, 509–512; 418/15, 55.1, 55.6, 418/61.3, 75–76, 88, 171, 270; 184/6.18; 417/13, 32, 228, 281, 310, 362, 366, 369, 417/372, 390, 410, 902
See application file for complete search history.

(56) References Cited

U.S. PATENT DOCUMENTS 3,242,867 A * 3/1966 Mosbacher ..... 418/15
6,240,734 B1 * 6/2001 Ferrier et al. ..... 62/139
6,679,692 B1 * 1/2004 Feuling ..... 418/171
7,390,180 B2 * 6/2008 Lee et al. ..... 418/88
2002/0033305 A1 3/2002 Koyama et al.
2007/0122303 A1 * 5/2007 Kim et al. ..... 418/55.6
2007/0160488 A1 * 7/2007 Yoo et al. ..... 418/55.6

FOREIGN PATENT DOCUMENTS

EP 2 020 577 A2 2/2009

* cited by examiner

*Primary Examiner* — Frantz Jules
*Assistant Examiner* — Emmanuel Duke
(74) *Attorney, Agent, or Firm* — McKenna Long & Aldridge LLP

(57) ABSTRACT

Disclosed are a hermetic compressor and a refrigeration cycle device having the same. An oil separator for separating oil from a refrigerant is installed outside a casing. The oil separated by the oil separator is recollected into the casing by an oil pump driven by a driving force of a driving motor. The oil is recollected from the refrigerant and fabrication costs are be reduced. A cooling capability of the refrigeration cycle device is enhanced, the compressor has a simplified configuration, and the fabrication costs are reduced. Because an outlet of a discharge opening through which oil is discharged to the casing from the oil pump is installed at a position lower than a minimum level of oil in the casing, the refrigerant is prevented from backflowing into an oil passage, and the occurrence of air bubbles on the surface of oil in the compressor may be prevented.

16 Claims, 8 Drawing Sheets

HERMETIC COMPRESSOR AND REFRIGERATION CYCLE DEVICE HAVING THE SAME

This application claims priority to Korean Patent Application No. 10-2008-0113671, filed on Nov. 14, 2008 in the Republic of Korea, the contents of which is hereby incorporated by reference in its entirety.

BACKGROUND OF THE INVENTION

1. Field of the Invention

The present invention relates to a hermetic compressor and a refrigeration cycle device having the same, and particularly, to a hermetic compressor capable of separating oil from a refrigerant discharged from a compression unit and recollecting the oil to the hermetic compressor, and a refrigeration cycle device having the same.

2. Background of the Invention

A compressor is an apparatus for converting mechanical energy into fluid compression energy. A hermetic compressor is provided with a driving motor for generating a driving force, and a compression unit for compressing fluid by receiving the driving force of the driving motor. The driving motor and the compression unit are installed in an inner space of a casing.

In a hermetic compressor for use in a refrigerant compression type refrigeration cycle, a preset amount of oil is stored in the casing so as to cool the driving motor and/or lubricate and seal the compression unit. However, when the hermetic compressor is being driven, refrigerant discharged from the hermetic compressor may be discharged to the refrigeration cycle in a mixed state with oil. And, some of the oil discharged to the refrigeration cycle may remain in the refrigeration cycle without being recollected into the hermetic compressor, resulting in oil deficiency inside the hermetic compressor. This may lower reliability of the hermetic compressor, and the refrigeration cycle may have a lowered heat exchange performance due to the oil remaining therein.

In order to solve these problems, has been proposed an oil recollecting apparatus capable of preventing oil deficiency inside a compressor and maintaining a heat exchange performance by a refrigeration cycle, by separating oil from a refrigerant discharged from an outlet of the compressor by using an oil separator installed at the outlet, and by recollecting the separated oil into an inlet of the compressor. However, the conventional oil recollecting apparatus for a hermetic compressor has the following problems.

First, because an outlet of the conventional oil separator is connected to the inlet of the compressor having a relatively low pressure, not only the oil separated by the oil separator but also the refrigerant may backflow to the inlet of the compressor. This may cause the amount of the refrigerant which circulates in the refrigeration cycle to be deficient, thereby resulting in a low cooling capability of the refrigeration cycle.

Second, because high-temperature oil and refrigerant are sucked to the inlet of the compressor, a suction refrigerant has an increased temperature. This may increase a volume ratio of the refrigerant, and thus the amount of the refrigerant sucked to the compression unit of the compressor is reduced. This may result in a lowered cooling capability of the compressor.

Third, because the oil separated by the oil separator is mixed with a sucked refrigerant thus to be discharged from the compression unit, oil deficiency may occur at the inner space of the casing. This may lower the reliability of the compressor.

SUMMARY OF THE INVENTION

Therefore, a feature of the invention is a provision of a hermetic compressor capable of preventing temperature increase of a refrigerant discharged from the compressor and sucked to the hermetic compressor due to oil separated from the refrigerant, and capable of forcibly recollecting the oil separated from the refrigerant into the compressor, and a refrigeration cycle device having the same.

Another feature of the invention is a provision of a hermetic compressor capable of preventing oil recollected into the hermetic compressor after being separated from a refrigerant discharged from the compressor, from being discharged out in a mixed state with a refrigerant sucked into the compressor, and a refrigeration cycle device having the same.

To achieve these and other advantages and in accordance with the purpose of the present invention, as embodied and broadly described herein, there is provided a hermetic compressor, comprising: a casing configured to store oil in an inner space of the casing; a driving motor installed within the inner space of the casing; a compression unit installed within the inner space of the casing and configured to compress a refrigerant when driven by the driving motor; an oil separator fluidly coupled to an outlet of the compressor and configured to separate oil from the compressed refrigerant discharged from the compression unit; an oil pump in fluid communication with the oil separator and configured to pump oil separated by the oil separator into the inner space of the casing; and a crankshaft coupled to the driving motor, the compression unit, and the oil pump and configured to transmit a driving force of the driving motor to both the compression unit and the oil pump, wherein the oil stored in the inner space of the casing flows through a length of the crankshaft within an oil passage of the crankshaft.

According to another aspect of the present invention, there is provided a hermetic compressor, comprising: a casing having an inner space; a driving motor installed within the inner space of the casing; a compression unit installed within the inner space of the casing and configured to compress a refrigerant when driven by the driving motor; a first oil pump configured to pump oil discharged from the compression unit into the inner space of the casing when driven in a coupled state to a crankshaft of the driving motor; and a second oil pump configured to pump oil stored within the inner space of the casing to bearing surfaces and the compression unit, wherein an outlet of the first oil pump is formed at a position equal to or lower than an inlet of the second oil pump.

According to another aspect of the present invention, there is also provided, a refrigeration cycle device, comprising: a compressor; a condenser connected to an outlet of the compressor; an expander connected to the outlet of the condenser; and an evaporator connected to the outlet of the expander, and connected to an inlet of the compressor, wherein the oil pump consists of a first oil pump and a second oil pump, the first oil pump recollects the oil separated from the refrigerant by the oil separator to the casing, and the second oil pump pumps oil stored in the casing to an oil passage of the crankshaft. The compressor may be, for example, either of the two hermetic compressors described in the two paragraphs immediately preceding this paragraph.

According to another aspect of the invention, there is also provided a compressor, comprising: a casing configured to store oil and refrigerant in an inner space of the casing, the refrigerant occupying the inner space of the casing above a surface of the oil, a height of the surface of the oil fluctuating between a first height and a second height, where the second height is less than the first height, according to an operation of the compressor; a compression unit, installed within the inner space of the casing, configured to compress refrigerant received through an inlet of the compressor and to discharge the compressed refrigerant into the inner space of the casing; an oil separator fluidly coupled to an outlet of the compressor and configured to separate oil from compressed refrigerant discharged from the inner space of the casing through the outlet of compressor; a first oil pump, installed within the inner space of the casing, in fluid communication with the oil separator and configured to pump oil separated by the oil separator from the oil separator into the inner space of the casing, wherein an outlet opening of the first oil pump is positioned at a third height, less than the second height, within the inner space of the casing.

The foregoing and other features, aspects, and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF EMBODIMENTS

Description will now be given in detail of embodiments of the invention, with reference to the accompanying drawings.

Hereinafter, a hermetic compressor and a refrigeration cycle device having the same according to an embodiment of the invention will be explained in more detail with reference to the attached drawings.

Figure 1:
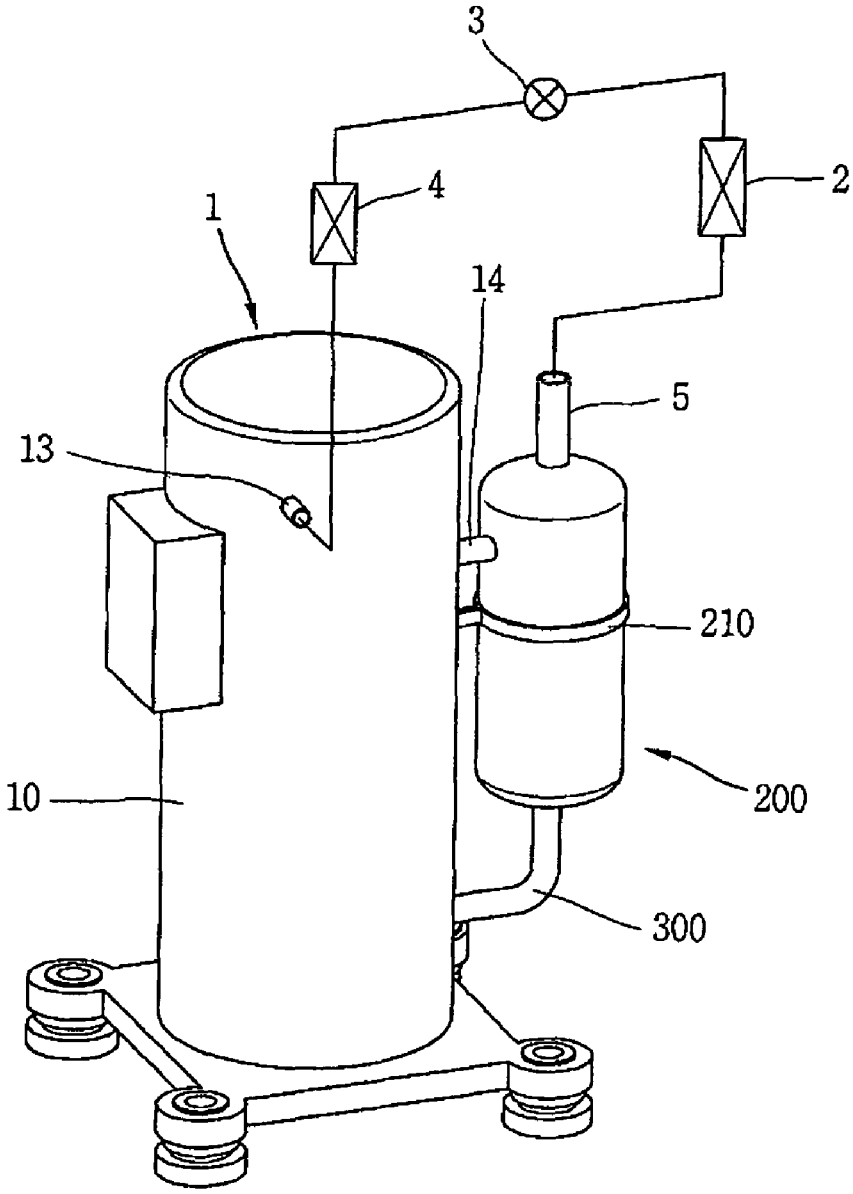
FIG. 1 is a perspective/schematic illustration showing an outside of a hermetic compressor connected to a refrigeration cycle according to an embodiment of the invention.
Figure 2:
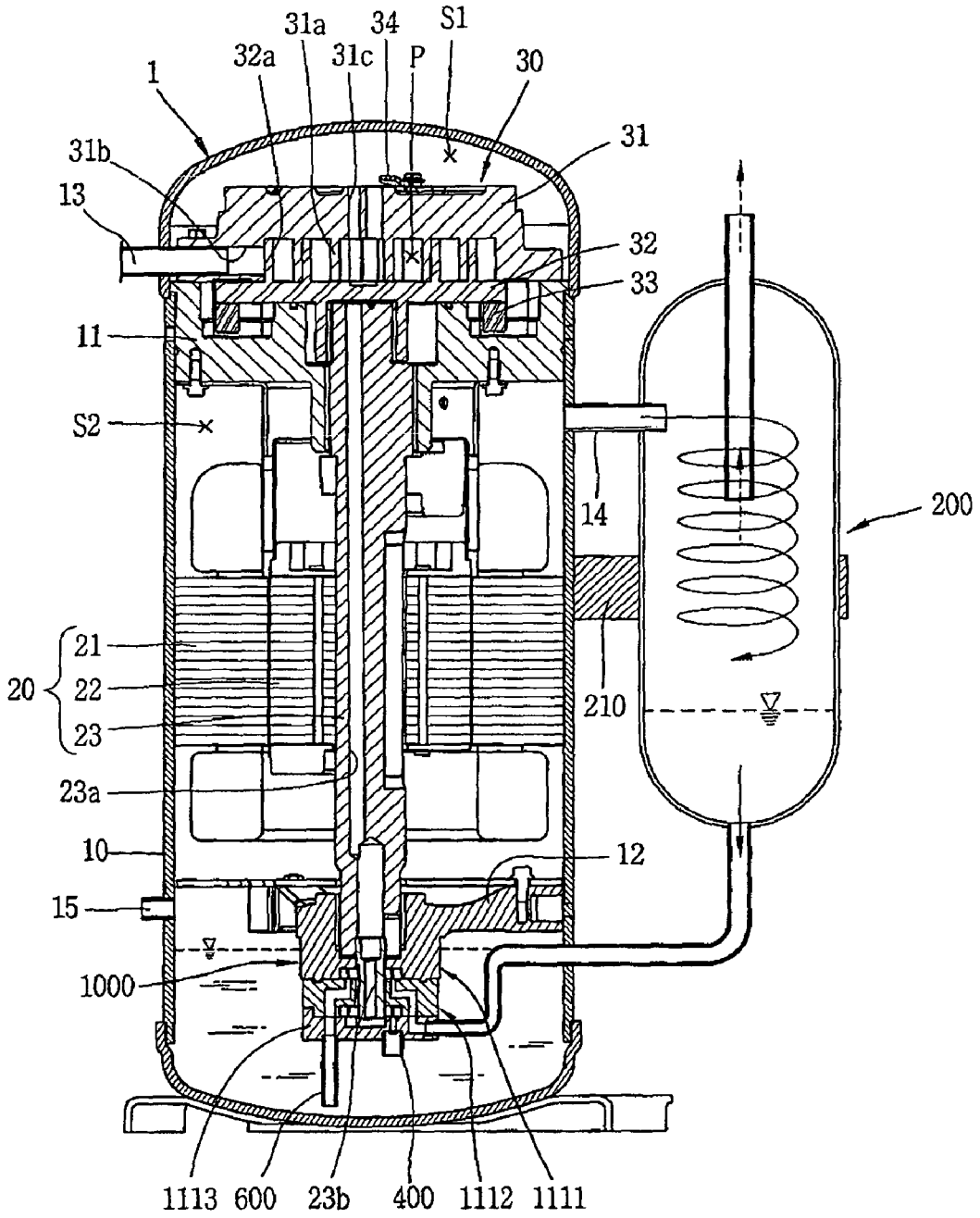
FIG. 2 is a longitudinal cross-sectional view showing an inside of the hermetic compressor of FIG. 1 wherein an oil pump is applied to a scroll compressor according an embodiment of the invention.

FIG. 1 is a perspective/schematic illustration showing an outside of a hermetic compressor connected to a refrigeration cycle according to an embodiment of the invention. FIG. 2 is a longitudinal cross-sectional view showing an inside of the hermetic compressor of FIG. 1 wherein an oil pump is applied to a scroll compressor according an embodiment of the invention.

As shown, the scroll compressor 1 comprises a compressor casing 10 having an inner space, a driving motor 20 installed at the inner space of the casing 10 and generating a driving force, and a compression unit 30 comprised of a fixed scroll 31 and an orbiting scroll 32 so as to compress a refrigerant while being driven by the driving force of the driving motor 20.

A main frame 11 and a sub-frame 12 for supporting not only a crankshaft 23 of the driving motor 20 but also the compression unit 30 are fixedly installed at upper and lower sides of the driving motor 20 within the inner space of the casing 10. A suction pipe 13 and a discharge pipe 14 are connected to the inner space of the casing 10 so that the compressor 1 can provide a refrigeration cycle in cooperation with a condenser 2, an expander 3, and an evaporator 4.

The suction pipe 13 may be connected to the evaporator 4 of the refrigeration cycle, whereas the discharge pipe 14 may be connected to the condenser 2 of the refrigeration cycle. The inner space of the casing 10 communicates with an outlet of the compression unit 30. The inner space of the casing 10 is filled with oil and gaseous refrigerant having a high discharge pressure. Oil may be added through oil fill port 15. In the disclosed embodiments, the oil is stored at the bottom of the casing 10. The refrigerant occupies the inner space of the casing above the oil. The suction pipe 13 is penetratingly formed at one side of the casing 10, and is fluidly coupled to an inlet of the compression unit 30. A direct connection is acceptable. An oil separator 200, to be described later, may be installed at an intermediate position of the discharge pipe 14, e.g., between the outlet of the compressor 1 and an inlet of the condenser 2. The oil separator 200 may be secured to the outside of the compressor 1 using a bracket 210. The oil separator 200 serves to separate oil from the gaseous refrigerant discharged to the condenser 2 from the compressor 1 through the discharge pipe 14.

As the driving motor 20, a constant-speed motor having a constant rotation speed may be used. However, an inverter motor having a variable rotation speed may be used with consideration of a multi-function of a refrigeration cycle device to which the compressor 1 is applied.

In the embodiment of FIG. 2, the driving motor 20 includes a stator 21 fixed to an inner circumferential surface of the casing 10, a rotor 22 rotatably disposed in the stator 21, and a crankshaft 23 coupled to the center of the rotor 22 and transmitting a rotation force generated from the driving motor 20 to the compression unit 30. The crankshaft 23 may be supported by the main frame 11 and the sub-frame 12. An oil passage 23*a* may be penetratingly formed within the crankshaft 23 in a lengthwise direction. The oil passage may be, for example, along or parralle to the rotational axis of the crankshaft 23. An oil pump 1000, to be described later, may be installed at a lower end of the oil passage 23*a*, e.g., at a lower end of the crankshaft 23, so as to pump oil into the oil passage 23*a*.

As shown in the embodiment of FIG. 2, the compression unit 30 includes a fixed scroll 31 coupled to the main frame 11; an orbiting scroll 32 for forming one pair of compression chambers (P) which consecutively move by being engaged with the fixed scroll 31; an Oldham's ring 33 installed between the orbiting scroll 32 and the main frame 11, for inducing an orbiting motion of the orbiting scroll 32; and a backflow preventing valve 34 installed so as to open and close a discharge opening 31*c* of the fixed scroll 31, for preventing backflow of gas discharged through the discharge opening 31*c*. The fixed scroll 31 and the orbiting scroll 32 are provided with a fixed wrap 31*a* and an orbiting wrap 32*a*, respectively. The fixed wrap 31*a* and the orbiting wrap 32*a* are each formed in a spiral shape, and form the compression chambers (P) by being engaged with each other. The suction pipe 13 for guiding a refrigerant from the refrigeration cycle may be directly connected to a suction opening 31*b* of the fixed scroll 31. And, the discharge opening 31*c* of the fixed scroll 31 is communicated with the inner space of the casing 10.

Once power is supplied to the driving motor 20, the crankshaft 23 is rotated together with the rotor 22 to transmit a rotational force to the orbiting scroll 32. Then, the orbiting scroll 32 having received the rotational force performs an orbiting motion on an upper surface of the main frame 11 by an eccentric distance, thereby forming one pair of compression chambers (P) which consecutively move between the fixed wrap 31*a* of the fixed scroll 31 and the orbiting wrap 32*a* of the orbiting scroll 32. As the compression chambers (P) have a decreased volume by moving toward its center, a sucked refrigerant is compressed. The compressed refrigerant is consecutively discharged to an upper space (S1) of the casing 10 through the discharge opening 31*c* of the fixed scroll 31, and then passes to a lower space (S2) of the casing 10. Then, the compressed refrigerant is discharged to the condenser 2 of the refrigeration cycle through the discharge pipe 14. The refrigerant discharged from the condenser 2 of the refrigeration cycle is sucked into the compressor 1 through the suction pipe 13 via the expander 3 and the evaporator 4. These processes are repeatedly performed.

A first oil pump 1200 and a second oil pump 1300 that will be later explained are installed at the crankshaft 23 in an axial direction. The oil pumps may respectively serve to pump oil separated from the refrigerant discharged from the compression unit 30 into the inner space of the casing 10 and pump oil stored within the inner space of the casing 10 toward the driving motor 20 and the compression unit 30. Oil pumped toward the compression unit 30 and driving motor 20 may travel through the oil passage 23*a* of the crankshaft 23. The oil may perform a lubrication operation for the compression unit 30 and cooling operation for the driving motor 20.

Figure 3:
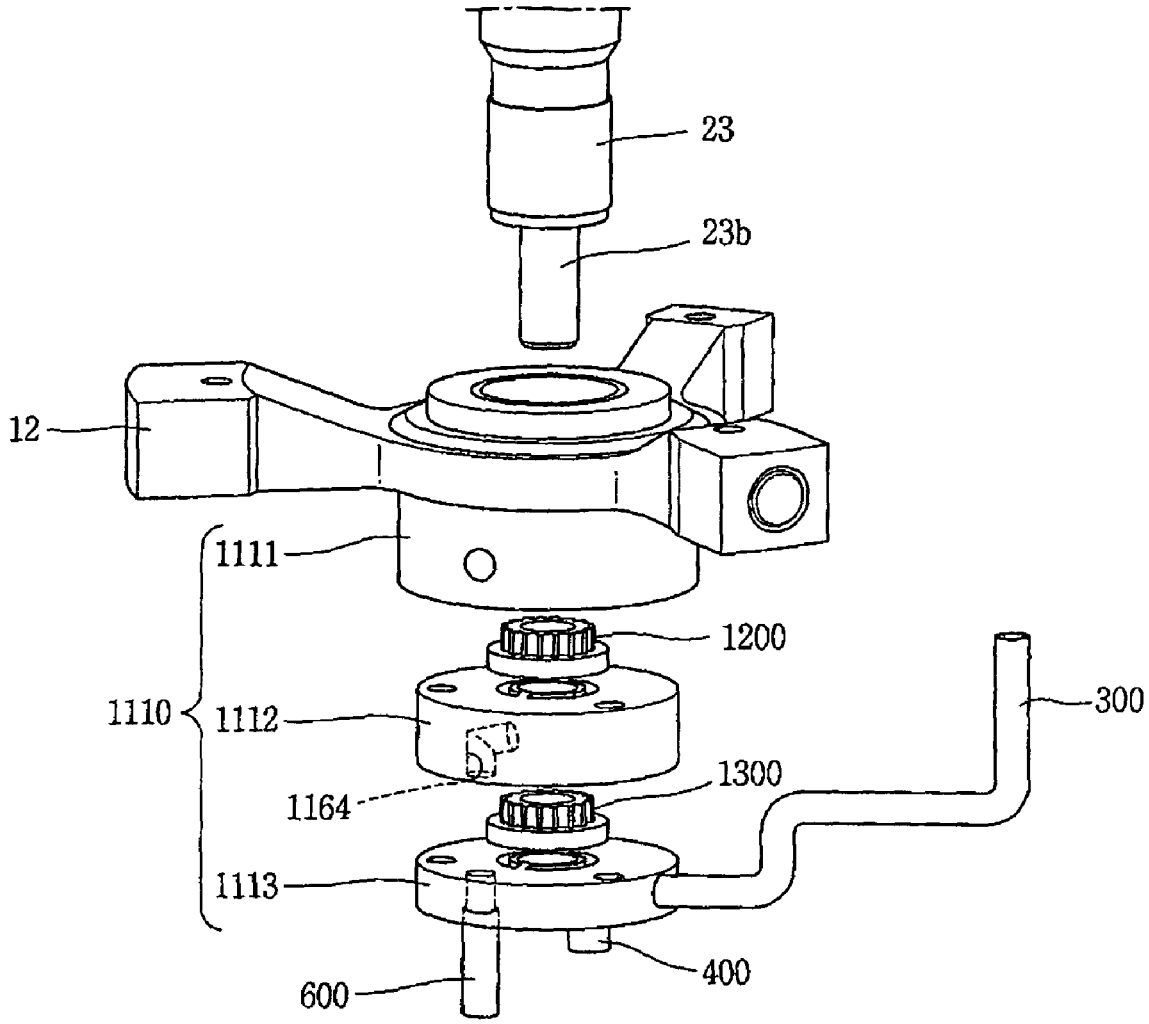
FIG. 3 is a disassembled perspective view of the oil pump of FIG. 2.
Figure 4:
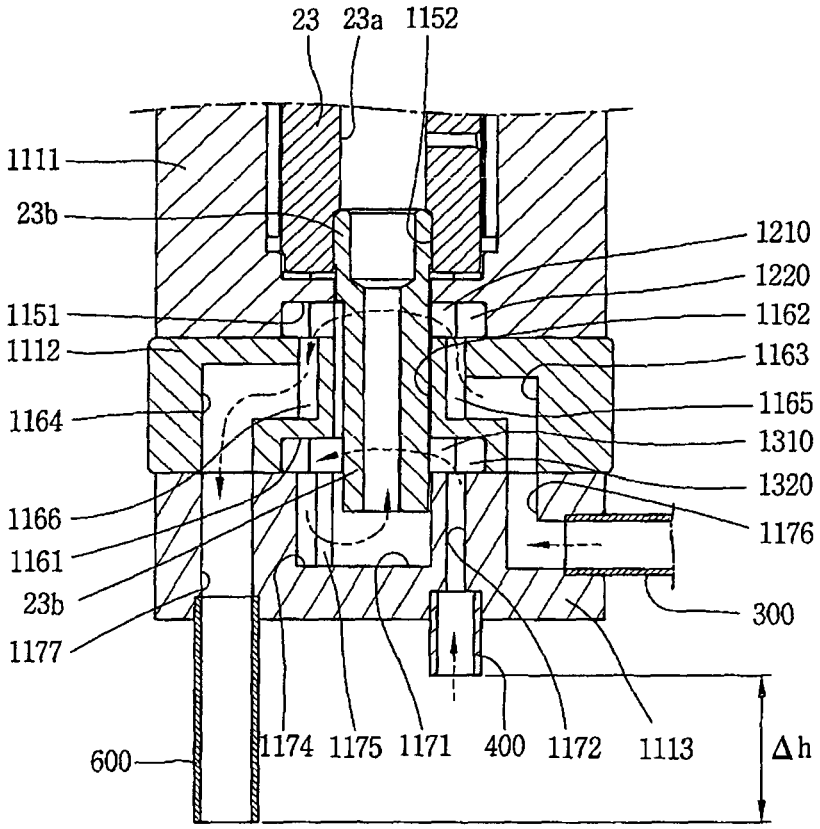
FIG. 4 is an assembled longitudinal cross-sectional view of the oil pump of FIG. 2.

Referring to FIGS. 2 to 4, the first oil pump 1200 consists of a first inner gear 1210 inserted into a first pumping space 1151 of a pump housing 1110, and eccentrically rotated by being coupled to the crankshaft 23; and a first outer gear 1220 engaged with the first inner gear 1210 to form a first variable capacity (volume).

The second oil pump 1300 consists of a second inner gear 1310 inserted into a second pumping space 1161 of the pump housing 1110, and eccentrically rotated by being coupled to the crankshaft 23; and a second outer gear 1320 engaged with the second inner gear 1310 to form a second variable capacity (volume).

The pump housing 1110 includes an upper housing 1111 coupled to the sub-frame 12; an intermediate housing 1112 disposed at a bottom surface of the upper housing 1111; and a lower housing 1113 disposed at a bottom surface of the intermediate housing 1112, and coupled to the upper housing 1111 together with the intermediate housing 1112.

At a bottom surface of the upper housing 1111, a first pumping space 1151 may be formed for inserting the first inner gear 1210 and the first outer gear 1220. In the middle of the first pumping space 1151, a first pin hole 1152 for penetratingly-inserting a pin portion 23*b* of the crankshaft 23 may be formed.

At a bottom surface of the intermediate housing 1112, a second pumping space 1161 for inserting the second inner gear 1310 and the second outer gear 1320 may be formed. In the middle of the second pumping space 1161, a second pin hole 1162 for penetratingly-inserting the pin portion 23*b* of the crankshaft 23 may be formed.

Figure 5:
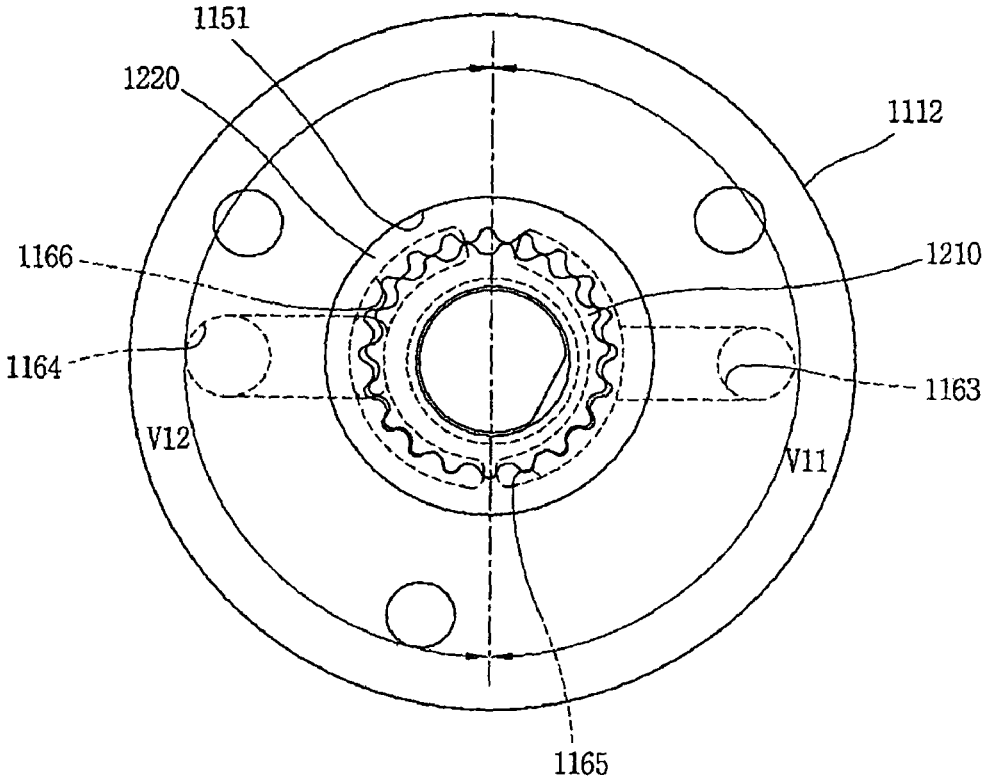
FIG. 5 is a planar view of an intermediate housing including an inner gear and an outer gear in a first oil pump of FIG. 4.

Referring to FIGS. 4 and 5, a first communication hole 1163 may be formed at the edge of the intermediate housing 1112 so that a first suction opening 1176, which will be described later, can communicate with a first suction capacity portion (V11) of the first oil pump 1200. At a side opposite to the side having the first communication hole 1163, a second communication hole 1164 may be formed so that a discharge opening 1177, which will be described later, can be communicated with a first discharge capacity portion (V12) of the first oil pump 1200. In the middle of the intermediate housing 1112, a first suction guide groove 1165 may be formed in a semicircular shape so that the first communication hole 1163 can be communicated with the first suction capacity portion (V11) between the first inner gear 1210 and the first outer gear 1220. At an opposite side to the first suction guide groove 1165, a first discharge guide groove 1166 may be formed so that the first discharge capacity portion (V12) between the first inner gear 1210 and the first outer gear 1220 can be communicated with the second communication hole 1164. In the disclosed embodiment, the second communication hole 1164 is bent in a "⌈" shape on an outer wall of the first discharge guide groove 1166, thereby being penetratingly formed on the bottom surface of the intermediate housing 1112. The first communication hole 1163 is bent in a "⌉" shape on an outer wall of the first suction guide groove 1165, thereby being penetratingly formed on the bottom surface of the intermediate housing 1112. The first communication hole 1163 may be formed to be communicated with the first suction opening 1176 of the lower housing 1113, and the first discharge guide groove 1166 may be formed to be communicated with the inner space of the casing 10.

Figure 6:
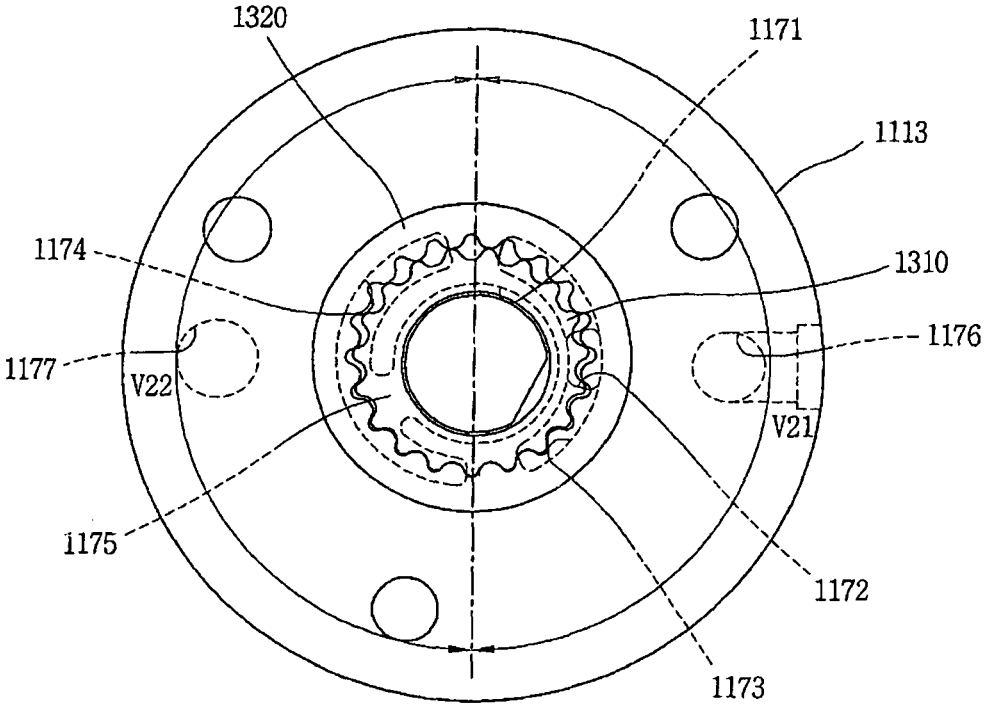
FIG. 6 is a planar view showing an upper surface of a lower housing including an inner gear and an outer gear in a second oil pump of FIG. 4.

Referring to FIGS. 4 and 6, a communication groove 1171 may be formed in the middle of the lower housing 1113 so as to be communicated with the oil passage 23*a* of the crankshaft 23. A second suction opening 1172 communicated with an oil supply pipe 400 may be formed at one side of the communication groove 1171 in an axial direction. At one side of the communication groove 1171, a second suction guide groove 1173 may be formed in a semicircular shape so that the second suction opening 1172 can be communicated with a second suction capacity portion (V21) between the second inner gear 1310 and the second outer gear 1320. At an opposite side to the second suction guide groove 1173, a second discharge guide groove 1174 may be formed so that a second discharge capacity portion (V22) between the second inner gear 1310 and the second outer gear 1320 can be communicated with the communication groove 1171. A discharge slit 1175 for guiding oil in the second discharge guide groove 1174 to the oil passage 23*a* of the crankshaft 23 may be formed on an inner side wall of the second discharge guide groove 1174 so as to be communicated with the communication groove 1171.

At one side of the lower housing 1113, e.g., at an outer side of the second suction guide groove 1173, the first suction opening 1176 is formed in a "⌉" shape so as to be penetrating an upper surface of the lower housing 1113 from an outer circumferential surface of the lower housing 1113. The discharge opening 1177 communicated with the second communication hole 1164 of the intermediate housing 1112 may be penetratingly formed so as to be penetrating both the upper and lower surfaces of the lower housing 1113 in an axial direction at an opposite side to the second suction opening 1172.

The surface level of the oil stored in the casing 10 varies in height according to the operation of the compressor. However, according to the embodiments described herein, whether the compressor is stopped or operating, a surface level of the oil stored in the inner space of the casing 10 should be higher than an outlet of the discharge opening 1177. If the outlet of the discharge opening 1177 is above the predetermined minimum level of oil in the casing 10, then an extension pipe, referred to herein as an oil discharge pipe 600, may be used. The oil discharge pipe 600 will be described later. The outlet of the discharge opening 1177, or the outlet end of the oil discharge pipe 600, may be positioned beneath the surface of the oil stored in the inner space of the casing 10. Such positioning may prevent refrigerant in the inner space of the casing 10 from backflowing into the first oil pump 1200 through the first discharge guide groove 1166.

In the embodiment of FIG. 4, the discharge opening 1177 is provided with an oil discharge pipe 600 at an outlet thereof, thereby allowing the outlet to have a lowered height. As shown in the embodiment of FIG. 4, the oil discharge pipe 600 may be insertion-coupled to the outlet of the discharge opening 1177 in an axial direction. A lower end of the oil discharge pipe 600 may be extended by a length (Δh), to result in a height that is equal to or less than a lower end of the oil supply pipe 400. The lower end is also lower than a predetermined height of a minimum level of oil in the inner space of the casing 10. In this configuration, air bubbles that occur when oil is pumped from the oil separator 200 into the inner space of the casing 10 may be prevented.

In the oil pumps of the scroll compressor according to an embodiment of the invention, oil separated by the oil separator 200 is introduced into the first suction guide groove 1165, which is coupled to the first suction capacity portion (V11) of the first oil pump 1200, through an oil recollection pipe 300 and the first suction opening 1176. Then, the oil introduced into the first suction guide groove 1165 is introduced into the first discharge guide groove 1166, which is coupled to the first discharge capacity portion (V12). Then, the oil introduced into the first discharge guide groove 1166 is discharged to the inner space of the casing 10 through the second communication hole 1164, the discharge opening 1177, and the oil discharge pipe 600.

The oil stored in the inner space of the casing 10, and the recollected oil from the oil separator 200 that was pumped into the inner space of the casing 10 through the first oil pump 1200, is introduced into the second suction guide groove 1173 which is coupled to the second suction capacity portion (V21) of the second oil pump 1300, through the oil supply pipe 400 and the second suction opening 1172. The oil introduced into the second suction guide groove 1173 is introduced into the second discharge guide groove 1174 which is coupled to the second discharge capacity portion (V22). The oil introduced into the second discharge guide groove 1174 is introduced into the communication groove 1171 through the discharge slit 1175. The oil introduced into the communication groove 1171 is supplied to bearing surfaces and the compression unit 30 through the oil passage 23*a* of the crankshaft 23. These processes are repeatedly performed.

In the process for recollecting oil pumped by the first oil pump 1200 into the inner space of the casing 10, if the outlet of the discharge opening 1177, the outlet communicated with the inner space of the casing 10, is disposed at a position higher than a level of the oil in the casing 10, the outlet of the discharge opening 1177 is exposed to the gaseous refrigerant having a high discharge pressure that fills the inner space of the casing 10 above the surface of the oil. Accordingly, the gaseous refrigerant may backflow toward the first oil pump 1200, thereby causing oil recollection to not be performed smoothly due to lowered efficiency of the first oil pump 1200. However, in accordance with the embodiments herein described, the outlet of the discharge opening 1177 is disposed at a position lower than the oil level. This is accomplished by extending the outlet of the discharge opening 1177 toward the bottom surface of the casing by coupling the oil discharge pipe 600 to the discharge opening 1177. This allows the outlet of the discharge opening to be disposed at a position lower than the oil level. Accordingly, the gaseous refrigerant of a high pressure may be prevented from backflowing into the first oil pump 1200. In the configuration of the embodiments described herein, the lower end of the oil discharge pipe 600 is also disposed at a position lower than the lower end of the oil supply pipe 400. In these embodiments, noise or air bubbles occurring when recollected oil falls down onto the surface of the oil stored in the inner space of the casing 10 is prevented.

Figure 7:
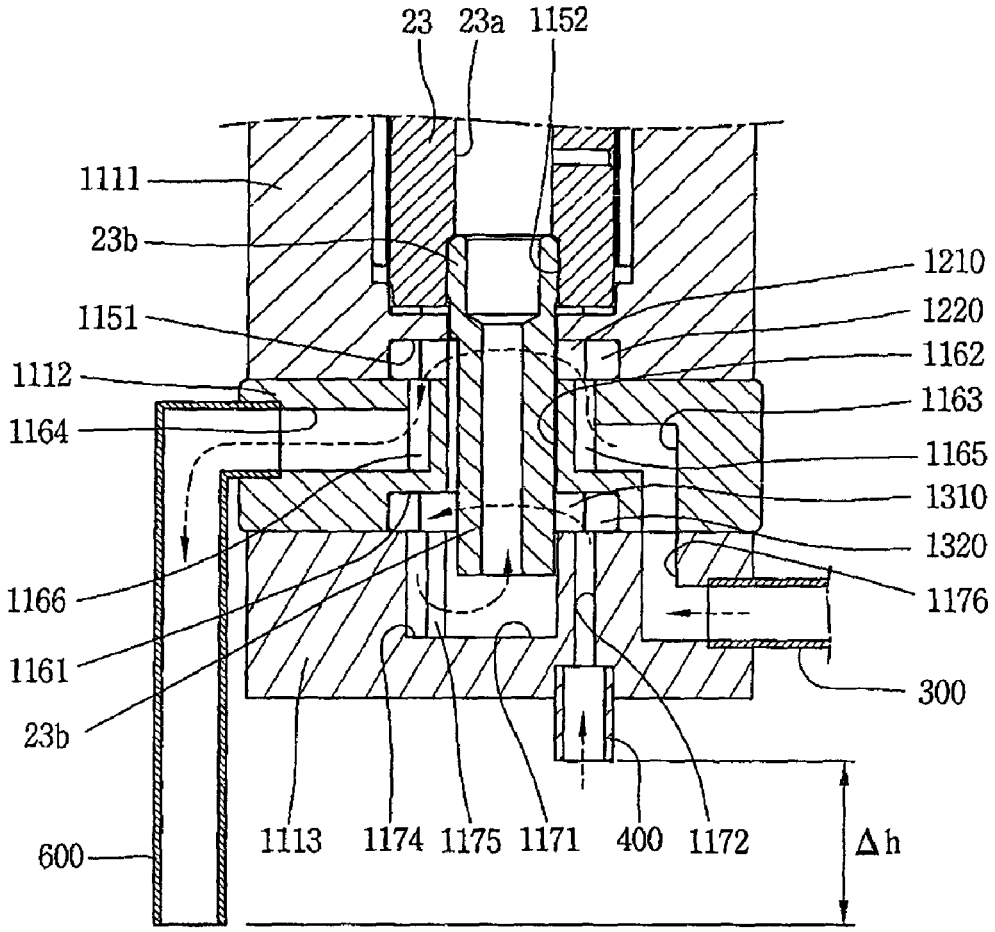
FIG. 7 is a longitudinal cross-sectional view showing an alternate oil discharge passage for use with the scroll compressor of FIG. 2 according to another embodiment of the invention.

As shown in the embodiment of FIG. 7, an outlet of the second communication hole 1164 may be penetratingly formed on an outer circumferential surface of the intermediate housing 1112. In this embodiment, the oil discharge pipe 600 is bent in a "⌈" shape having one end coupled to the outlet of the second communication hole 1164 and the other end extended to a position lower than the predetermined minimum height of oil in the casing 10. Thus, as in the embodiment of FIG. 4, the outlet of the second communication hole 1164 is extended to a position lower than the predetermined minimum height of oil in the casing 10. In the embodiments of FIGS. 4 and 7, the lower end of the oil discharge pipe 600 is located at a position lower than the lower end of the oil supply pipe 400 by Δh. In the embodiment of FIG. 7, however, the lower housing 1113 does not require a discharge opening (similar to discharge opening 1177 of FIG. 4) to be penetratingly manufactured therethrough.

As the oil separated by the oil separator is forcibly recollected into the inner space of the casing 10 by the first oil pump 1200, the amount of oil in the inner space of the casing 10 is increased. This increase may enhance heat exchange performance by the refrigeration cycle, and may enhance cooling capability of the refrigeration cycle.

As the oil forcibly recollected into the inner space of the case is introduced into the oil stored in the casing 10 without falling from the discharge opening onto the surface of the oil in the casing 10, the oil is prevented from being discharged out after being re-mixed with a sucked refrigerant. If oil mixed with sucked refrigerant is introduced into the casing 10, then the refrigerant will re-expand in the inner space of the casing 10 and thereby reduce the performance and reliability of the compressor. In the embodiments described herein, however, prior to being pumped into the inner space of the casing 10 from the oil separator 200, the oil is separated from the sucked refrigerant and the entrapped sucked refrigerant is not introduced into the inner space of the casing 10 by operation of the pump 1200. This may enhance the performance and reliability of the compressor, and may enhance a cooling capability of the refrigeration cycle.

The oil separated by the oil separator 200 is not directly introduced into the oil passage 23*a* of the crankshaft 23, but is guided to the oil passage 23*a* of the crankshaft 23 after being first recollected into the inner space of the casing 10. Accordingly, foreign materials present in a circulation path of the refrigeration cycle are prevented from being directly introduced into the oil passage 23*a* of the crankshaft 23. Therefore, it is envisioned that a foreign material filtering device need not be installed at the inlet of the compressor. As a result, the entire fabrication cost of the compressor may be reduced.

Furthermore, the discharge opening 1177 through which oil is discharged the inner space of the casing 10 from the first oil pump 1200 is extended toward the bottom of the casing by the oil discharge pipe 600. The outlet of the oil discharge pipe 600 is located at a position lower than the predetermined minimum oil level. This configuration may prevent the gaseous refrigerant occupying the inner space of the casing 10 above the surface of the oil from being introduced into the first pump 1200, and may prevent the occurrence of air bubbles forming on the surface of the oil in the inner space of the casing 10. Accordingly, oil may be smoothly supplied from the oil separator 200 to the inner space of the casing 10.

When a scroll compressor according to an embodiment of the invention is applied to a refrigeration cycle device, the refrigeration cycle device may have enhanced performance.

Figure 8:
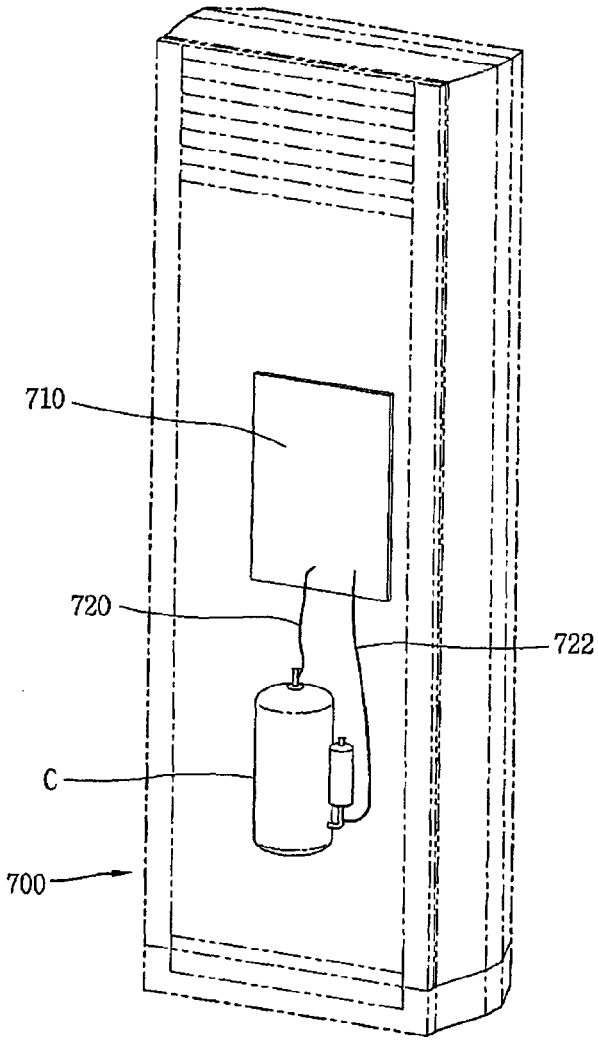
FIG. 8 is a view schematically showing a refrigeration cycle device having the hermetic compressor of FIG. 1.

Referring to FIG. 8, a refrigeration cycle device 700 includes a refrigerant compression type refrigeration cycle which includes a compressor, a condenser, an expander, and an evaporator, all according to the embodiments of the invention described herein. The compressor of the device 700 is a scroll compressor (C) having the first and second oil pumps according to an embodiment of the invention. The scroll compressor (C) operationally communicates with a controller 710 via one or more communication busses or electrical signal wires 720, 722. The controller 710 controls the operation of the refrigeration cycle device 700.

The hermetic compressor and the refrigeration cycle device having the same have the following advantages.

First, the oil separator 200 for separating oil from the refrigerant discharged from the compression unit 30 can be installed inside or outside the casing 10. The oil separated by the oil separator is recollected into the oil pump 1000, which is driven by a driving force of the driving motor 20. Accordingly, the oil may be effectively separated from the refrigerant, and the fabrication costs may be reduced.

Second, because the refrigerant separated from the oil is prevented from being re-introduced into the compressor 1, a cooling capability of the refrigeration cycle device may be enhanced.

Third, because the oil pump 1000 is driven by the driving force of the driving motor 20, the compressor 1 may have a simplified configuration, and the fabrication costs may be reduced.

Fourth, the outlet of the discharge opening through which oil is discharged into the casing 10 from the first pump 1200 of the oil pump 1000 is installed at a position lower than the predetermined minimum oil level in the casing 10. Accordingly, the gaseous refrigerant present in the inner space of the casing 10 is prevented from being introduced into the first pump 1200, and the occurrence of air bubbles on the surface of the oil in the casing 10 is prevented.

Although the embodiments described herein were applied to a scroll compressor, the scope of the invention is not limited thereto. For example, the invention may be applied to other types of hermetic compressors, such as a rotary compressor or a reciprocating compressor, where a driving motor and a compression unit are installed in the same casing, and an inner space of the casing is filled with a discharged refrigerant.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A hermetic compressor, comprising:

a casing configured to store oil in an inner space of the casing;

a driving motor installed within the inner space of the casing;

a compression unit installed within the inner space of the casing and configured to compress a refrigerant when driven by the driving motor;

an oil separator fluidly coupled to an outlet of the compressor and configured to separate oil from the compressed refrigerant discharged from the compression unit;

an oil pump in fluid communication with the oil separator and configured to pump oil separated by the oil separator into the inner space of the casing; and a crankshaft coupled to the driving motor, the compression unit, and the oil pump and configured to transmit a driving force of the driving motor to both the compression unit and the oil pump, the oil stored in the inner space of the casing flows through a length of the crankshaft within an oil passage of the crankshaft; and the oil pump comprises a first oil pump and a second oil pump, the first oil pump configured to pump recollected oil separated from the refrigerant by the oil separator to the casing, and the second oil pump configured to pump oil stored in the inner space of the casing into the oil passage of the crankshaft, wherein an outlet of the first oil pump is disposed at a position lower than an inlet of the second oil pump, an upper housing having a first pumping space which accommodates the first oil pump therein is installed within the casing, an intermediate housing having a second pumping space for accommodating the second oil pump therein is installed on a bottom surface of the upper housing, a lower housing having a communication groove which communicates the second pumping space with the oil passage of the crankshaft is installed on a bottom surface of the intermediate housing, the inlet of the first oil pump is formed by a first suction passage which consecutively penetrates the lower housing and the intermediate housing, and the outlet of the first oil pump is formed by a first discharge passage which consecutively penetrates the intermediate housing and the lower housing and leads to the inner space of the casing, and an inlet of the second oil pump is formed by a second suction passage of the lower housing, and an outlet of the second oil pump is formed by the communication groove.

2. The hermetic compressor of claim 1, wherein the oil separator is outside of the casing.

3. The hermetic compressor of claim 1, wherein an oil discharge pipe having a preset length is coupled to an outlet of the first discharge passage, and wherein the preset length of the oil discharge pipe is such that a height of an outlet end of the oil discharge pipe is lower than a predetermined minimum level of oil stored in the casing.

4. The hermetic compressor of claim 1, wherein an oil discharge pipe having a preset length is coupled to an outlet of the first discharge passage, and wherein the preset length of the oil discharge pipe is such that a height of an outlet end of the oil discharge pipe is less than a predetermined minimum level of oil stored in the casing and lower than an inlet of the second suction passage.

5. The hermetic compressor of claim 1, wherein an oil discharge pipe having a preset length is coupled to an outlet of the first discharge passage, wherein an oil suction pipe having a preset length is coupled to an inlet of the second suction passage, and wherein the length of the oil discharge pipe is such that an outlet end of the oil discharge pipe is lower than an inlet end of the oil suction pipe.

6. The hermetic compressor of claim 1, wherein an oil discharge pipe having a preset length is coupled to an outlet of the first discharge passage, and wherein the preset length of the oil discharge pipe is such that the end of the oil discharge pipe is lower than an inlet of the second suction passage.

7. A refrigeration cycle device, comprising:

the hermetic compressor of claim 1, a hermetic compressor inlet fluidly coupled to a compression unit inlet;

a condenser having an inlet and an outlet, the condenser inlet fluidly coupled to the hermetic compressor outlet;

an expander having an inlet and an outlet, the expander inlet fluidly coupled to the condenser outlet; and an evaporator having an inlet and an outlet, the evaporator inlet fluidly coupled to the expander outlet, the evaporator outlet fluidly coupled to the hermetic compressor inlet.

8. The refrigeration cycle device of claim 7, wherein:

the condenser is fluidly coupled to the inner space of the casing via the oil separator, and the evaporator outlet is directly connected to the compression unit inlet.

9. A hermetic compressor, comprising:

a casing having an inner space;

a driving motor installed within the inner space of the casing;

a compression unit installed within the inner space of the casing and configured to compress a refrigerant when driven by the driving motor;

a first oil pump configured to pump oil discharged from the compression unit into the inner space of the casing when driven in a coupled state to a crankshaft of the driving motor; and a second oil pump configured to pump oil stored within the inner space of the casing to bearing surfaces and the compression unit, wherein an outlet of the first oil pump is formed at a position equal to or lower than an inlet of the second oil pump, wherein an upper housing having a first pumping space which accommodates the first oil pump therein is installed within the casing, an intermediate housing having a second pumping space for accommodating the second oil pump therein is installed on a bottom surface of the upper housing, a lower housing having a communication groove which communicates the second pumping space with an oil passage of the crankshaft is installed on a bottom surface of the intermediate housing, an inlet of the first oil pump is formed by a first suction passage which consecutively penetrates the lower housing and the intermediate housing, and the outlet of the first oil pump is formed by a first discharge passage which consecutively penetrates the intermediate housing and the lower housing and leads to the inner space of the casing, and the inlet of the second oil pump is formed by a second suction passage of the lower housing, and an outlet of the second oil pump is formed by the communication groove.

10. The hermetic compressor of claim 9, wherein the outlet of the first oil pump is formed toward a bottom surface of the casing.

11. The hermetic compressor of claim 9, wherein an oil discharge pipe is coupled to the outlet of the first oil pump, and wherein the oil discharge pipe is formed to have a length such that a height of an outlet of the oil discharge pipe is less than a predetermined minimum height of oil stored within the inner space of the casing.

12. The hermetic compressor of claim 9, wherein the outlet of the first oil pump is formed on a surface perpendicular to a bottom surface of the casing, wherein an oil discharge pipe having an inlet end and an outlet end is coupled, at its inlet end, to the outlet of the first oil pump, and wherein the oil discharge pipe is curvedly formed such that the outlet end of the oil discharge pipe is directed toward the bottom surface of the casing.

13. A refrigeration cycle device, comprising:

the hermetic compressor of claim 9, a hermetic compressor inlet fluidly coupled to a compression unit inlet;

a condenser having an inlet and an outlet, the condenser inlet fluidly coupled to the hermetic compressor outlet;

an expander having an inlet and an outlet, the expander inlet fluidly coupled to the condenser outlet; and an evaporator having an inlet and an outlet, the evaporator inlet fluidly coupled to the expander outlet, the evaporator outlet fluidly coupled to the hermetic compressor inlet.

14. The refrigeration cycle device of claim 13, wherein:

the condenser is fluidly coupled to the inner space of the casing via the oil separator, and the evaporator outlet is directly connected to the compression unit inlet.

15. A compressor, comprising:

a casing configured to store oil and refrigerant in an inner space of the casing, the refrigerant occupying the inner space of the casing above a surface of the oil, a height of the surface of the oil fluctuating between a first height and a second height, where the second height is less than the first height, according to an operation of the compressor;

a compression unit, installed within the inner space of the casing, configured to compress refrigerant received through an inlet of the compressor and to discharge the compressed refrigerant into the inner space of the casing;

an oil separator fluidly coupled to an outlet of the compressor and configured to separate oil from compressed refrigerant discharged from the inner space of the casing through the outlet of compressor;

a first oil pump, installed within the inner space of the casing, in fluid communication with the oil separator and configured to pump oil separated by the oil separator from the oil separator into the inner space of the casing, wherein an outlet opening of the first oil pump is positioned at a third height, less than the second height, within the inner space of the casing, the first oil pump configured to pump the oil separated by the oil separator to the casing, and the second oil pump configured to pump oil stored in the inner space of the casing into an oil passage of a crankshaft, wherein an outlet of the first oil pump is disposed at a position lower than an inlet of the second oil pump, an upper housing having a first pumping space which accommodates the first oil pump therein is installed within the casing, an intermediate housing having a second pumping space for accommodating the second oil pump therein is installed on a bottom surface of the upper housing, a lower housing having a communication groove which communicates the second pumping space with the oil passage of the crankshaft is installed on a bottom surface of the intermediate housing, the inlet of the first oil pump is formed by a first suction passage which consecutively penetrates the lower housing and the intermediate housing, and the outlet of the first oil pump is formed by a first discharge passage which consecutively penetrates the intermediate housing and the lower housing and leads to the inner space of the casing, and an inlet of the second oil pump is formed by a second suction passage of the lower housing, and an outlet of the second oil pump is formed by the communication groove.

16. The compressor of claim 15, further comprising:

a driving motor installed within the inner space of the casing;

the crankshaft coupled to the driving motor, the compression unit, and the first oil pump and configured to transmit a driving force of the driving motor to both the compression unit and the first oil pump, wherein the crankshaft comprises the oil passage formed within the crankshaft and extending along a length of the crankshaft and wherein the oil passage is configured to supply oil to bearing surfaces and the compression unit.

* * * * *